US006450784B2

(12) United States Patent
Newcomer

(10) Patent No.: US 6,450,784 B2
(45) Date of Patent: Sep. 17, 2002

(54) AIR-OPERATED PUMPS WITH REMOVABLE CARTRIDGES AND IMPROVED MANIFOLD ATTACHMENT MECHANISMS

(76) Inventor: Kevin L. Newcomer, 13734 Shady La., Monroe, MI (US) 48161

( * ) Notice: Subject to any disclaimer, the term of this patent is extended or adjusted under 35 U.S.C. 154(b) by 0 days.

(21) Appl. No.: 09/817,724

(22) Filed: Mar. 26, 2001

Related U.S. Application Data

(63) Continuation-in-part of application No. 09/370,771, filed on Aug. 9, 1999, now Pat. No. 6,206,657.
(60) Provisional application No. 60/194,497, filed on Apr. 3, 2000.

(51) Int. Cl.[7] ..... F04B 43/10; F04F 1/06
(52) U.S. Cl. ..... 417/394; 417/118; 417/131; 417/137; 417/472
(58) Field of Search ..... 417/394, 118, 417/131, 137, 472, 395, 478, 479

(56) References Cited

U.S. PATENT DOCUMENTS

| | | | | |
|---|---|---|---|---|
| 2,564,198 A | | 8/1951 | Elkins | |
| 3,113,455 A | | 12/1963 | Sloan et al. | |
| 4,669,554 A | | 6/1987 | Cordry | |
| 4,717,473 A | | 1/1988 | Burge et al. | |
| 4,807,707 A | * | 2/1989 | Handley et al. | 175/20 |
| 4,943,210 A | | 7/1990 | Bailey, Jr. et al. | |
| 4,974,674 A | | 12/1990 | Wells | |
| 5,027,902 A | | 7/1991 | Dickinson et al. | |
| 5,099,920 A | | 3/1992 | Warburton et al. | |
| 5,238,060 A | * | 8/1993 | Niehaus et al. | 166/68 |
| 5,293,934 A | | 3/1994 | Burge | |
| 5,708,220 A | | 1/1998 | Burge | |
| 6,206,657 B1 | * | 3/2001 | Newcomer | 417/394 |
| 6,224,343 B1 | * | 5/2001 | Newcomer | 417/118 |

* cited by examiner

*Primary Examiner*—Teresa Walberg
*Assistant Examiner*—Vinod D. Patel
(74) *Attorney, Agent, or Firm*—Gifford, Krass, Groh, Sprinkle, Anderson & Citkowski, PC

(57) ABSTRACT

An air-operated pump for groundwater sampling and other applications includes a removable cartridge coupled to a manifold configured to receive air-inlet and fluid-discharge tubes from an above-ground location. The removable cartridge may be in the form of a bellows or bladder, and may be removably attachable to the pump body through a press fitting. In contrast to prior implementations, the pump body features a manifold with fittings enabling the air-inlet and fluid-discharge tubes to be respectively inserted and sealed into the air-inlet and fluid-discharge ports. In the preferred embodiment, the fittings are such that the associated tubes cannot be removed without modification. For example, the fittings may include a grab plate associated with one or both of the air-inlet and fluid-discharge ports. Each grab plate includes an aperture with finned serrations such that through proper sizing of the plate features and associated tubing, the tube(s) may be inserted and sealed through appropriate compression. Such compression may be provided through the construction of an upper cover, preferably provided with a two-stage bayonet mount, or the fittings may include a compression adapter with one or more sets of O-rings associated with one or both of the air-inlet and fluid-discharge ports.

7 Claims, 6 Drawing Sheets

AIR-OPERATED PUMPS WITH REMOVABLE CARTRIDGES AND IMPROVED MANIFOLD ATTACHMENT MECHANISMS

REFERENCE TO RELATED APPLICATIONS

This application claims priority from U.S. provisional patent application Ser. No. 60/194,497, filed Apr. 3, 2000; and is a continuation-in-part of U.S. patent application Ser. No. 09/370,771, filed Aug. 9, 1999 now U.S. Pat. No. 6,206,657, the entire contents of both applications are incorporated herein by reference.

FIELD OF THE INVENTION

This invention relates generally to pumps for groundwater sampling and the like, and, more particularly, to automated air-operated pumps with removable cartridges and improved manifold attachment mechanisms.

BACKGROUND OF THE INVENTION

There does exist many types of submersible pumps for groundwater sampling and other uses. FIG. 1 shows, generally at 10, a typical prior-art configuration. Since devices of this kind are inserted down well holes, the unit consists of an outer cylindrical pump body 2, typically constructed of stainless steel. The body includes a lower inlet end 4 and an upper outlet end 6. An internal cylindrical bladder 8, typically constructed of Teflon, partitions the interior of the pump body 2 into a gas-carrying section 11, and a fluid-carrying section 12 within the bladder 8.

A tube 14 having, perforations 16, is generally positioned within the fluid-carrying section 12, as shown. A lower check valve 20 is provided at the lower inlet end 4 to permit groundwater or like fluids to pass through the lower end 4 and into the tube 14 and fluid-carrying chamber 12 through perforations 16. The check valve 20 also prevents the fluid from backflowing through the lower inlet 4. An upper check valve 22 allows fluid from the fluid-carrying chamber 12 to be discharged through the upper end 6 by passing through apertures 16 and into the tube 14. The upper check valve 22 also prevents the fluid from backflowing down into the pump interior.

Above ground, a controller 30 is provided having a conduit 32 in pneumatic communication with the gas-carrying section 11 within the pump body 2. The apparatus operates by pressurizing and venting the gas within the chamber 11, thereby compressing and expanding the bladder 8, which is quite flexible, thereby forcing fluid within the chamber 12 out the upper end 6 through tube 14 by way of apertures 16. More particularly, when the pump body is submerged, ground water or other fluid flows into the chamber 12 through tube 14 having apertures 16 through the lower end 4, bypassing check valve 20 due to natural hydrostatic pressure.

When an actuating gas such as compressed air is driven through conduit 32 and into the gas-carrying section 11, the bladder 8 is compressed and the lower check valve 20 is forced against the opening 4, thereby forcing the fluid contained within the fluid-carrying section upwardly and out through the upper opening 6, displacing check valve 22 in its path. The gas-carrying chamber 11 is then vented at ground level through controller 30, permitting a fresh charge of ground water to again fill the fluid-carrying chamber 12 and tube 14 through perforations 16, at which time another cycle may be started by compressing the bladder 8.

Although a single controller 30 may be configured to control a multiplicity of similar pumps, the timing sequences for each pump must be optimized and stored to ensure the most efficient operation for each sampling station. The timing/cycling means within the controller therefore typically includes a 3-way valve associated with each pump to which it is connected. The 3-way valve is alternatively actuated and de-actuated to produce a pulsating flow to the bladder of each pump, wherein a compressed gas is applied via each conduit 32, on which the 3-way valve changes state, enabling the gas contained within chamber 11 to be vented to atmosphere. The controller 30 must therefore include electronic, pneumatic or mechanical timing devices associated with each 3-way valve, in each pump, to ensure proper operation thereof.

Pumps of the type just described are used in a variety of applications, including the continuous collection of gasoline and other hazardous materials from aquifers, as well as occasional groundwater sampling. There is also a need for pumps used for more infrequent sampling, using a device sometimes referred to as a "bailor." Originally, such devices assumed the form of a polyethylene or Teflon tube having a bottom end with a check ball. The device was lowered into a well, allowing liquid to trickle past the check ball until the tube was filled and the check ball was seated. The device was then removed form the well, the sample removed, and the rest of the device discarded.

By EPA mandate, the bailing process must remove three times the volume of a well before a sample is taken. This means that if the volume of the well is 50 gallons, 150 bailing operations must be taken prior to taking the actual sample. The time-consuming nature of this process led to the development of continuously cycling sampling pumps of the type described with reference to FIG. 1. Even with these, however, the apparatus is expensive, and the bladder must be removed, typically requiring a meticulous dismantling of the pump body. The need therefore remains for an economical pump capable of repetitive sampling. Ideally, such a pump would include some form of collection cartridge that is easily removable, allowing the pump to be used for more infrequent sampling applications, including bailing.

SUMMARY OF THE INVENTION

This invention resides in an air-operated pump for groundwater sampling and other applications, including a removable cartridge coupled to a manifold configured to receive air-inlet and fluid-discharge tubes from an above-ground location. A submersible pump according to the invention includes a pump body having a fluid inlet port, an air-supply port and a fluid-discharge port. The removable cartridge is disposed within the pump body. The removable cartridge may be in the form of a bellows or bladder, and may be removably attachable to the manifold portion of the pump body through a press fitting.

As in previous designs, the cartridge is operable between a refill state, wherein fluid is drawn into the pump body through the fluid inlet port, and a discharge state wherein fluid is forced out of the pump body through the fluid-discharge port. In contrast to prior implementations, however, the pump body features a manifold with fittings enabling the air-inlet and fluid-discharge tubes to be respectively inserted and sealed into the air-inlet and fluid-discharge ports.

In the preferred embodiment, the fittings are such that the associated tubes cannot be removed without modification. For example, the fittings may include a grab plate associated with one or both of the air-inlet and fluid-discharge ports. Each grab plate includes an aperture with finned serrations such that through proper sizing of the plate features and associated tubing, the tube(s) may be inserted and sealed through appropriate compression. Such compression may be provided through the construction of an upper cover, preferably provided with a two-stage bayonet mount, or the fittings may include a compression adapter with one or more sets of O-rings associated with one or both of the air-inlet and fluid-discharge ports.

DETAILED DESCRIPTION OF THE INVENTION

U.S. Pat. No. 6,206,657 describes various pump configurations of the type used for groundwater sampling, including the removal of gasoline or other hazardous materials. In contrast to existing designs, however, the embodiments of the '657 patent teach a collapsible bellows as opposed to the traditional bladder used for fluid collection. The substitution of a bellows over a flexible bladder offers a number of advantages over conventional designs, including the potential for truly automatic operation; that is, continuous cycling without necessarily relying on an above-ground controller to precisely time out the charge and discharge portions of each cycle. The bellows is preferably positioned with the open end oriented upwardly during normal operation, thereby allowing trapped gas to escape. Given this orientation, the design also provides a pump head manifold arrangement enabling the fluid-collection canister to be easily changed, thereby accommodating both long-term, continuous cycling or bailing-type applications.

This invention resides in certain improvements over the embodiments described and claimed in the '657 patent. The bellows connector manifold is similar in terms of the way in which the check balls operate. However, at least certain of the threaded retainers and other features have been improved from an engineering viewpoint, enabling faster set up with fewer more expensive fastener components.

Figure 1:
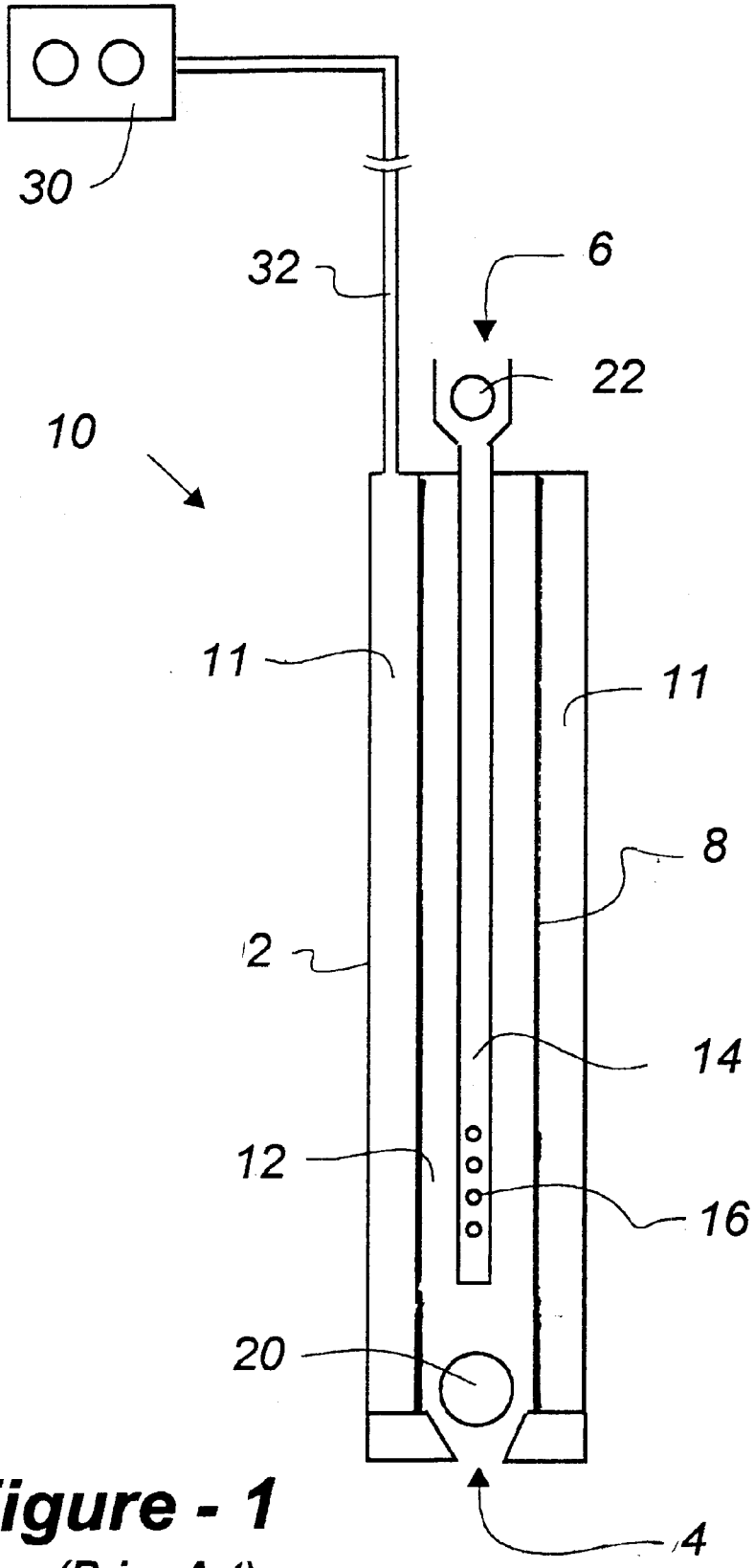
Figure - 1 (Prior Art)
FIG. 1 is a simplified drawing of a prior-art, air-operated ground water pump wherein a thin-walled bladder is alternatively compressed and vented to atmosphere.
Figure 2A:
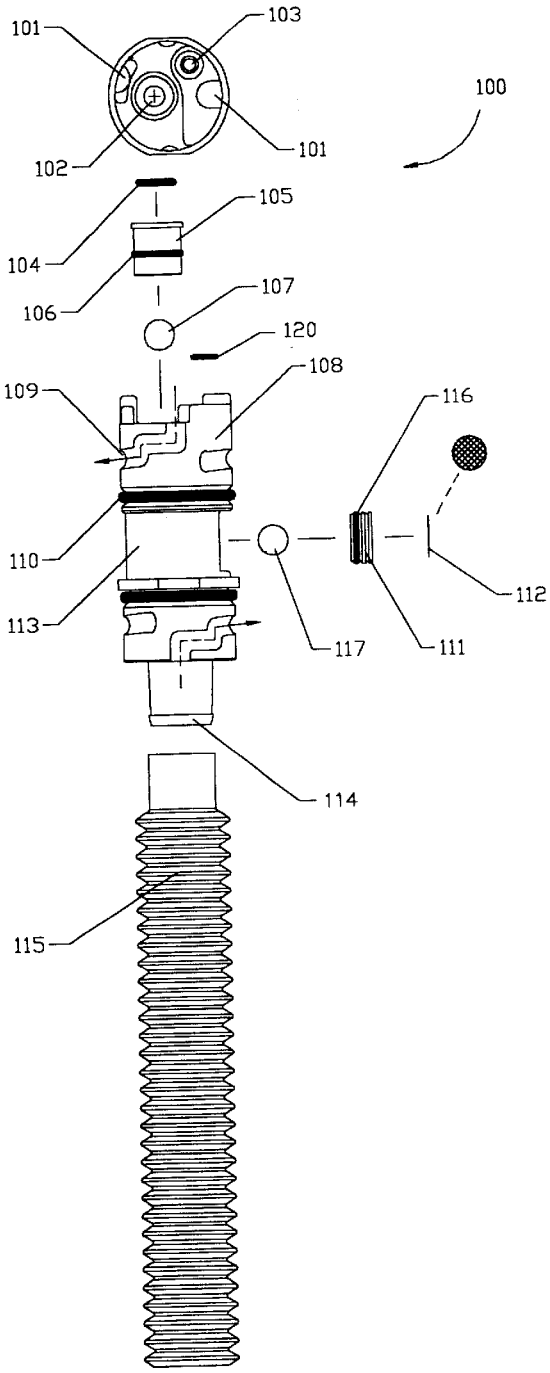
FIG. 2A is a bellows pump according to the invention in a disassembled state.
Figure 2B:
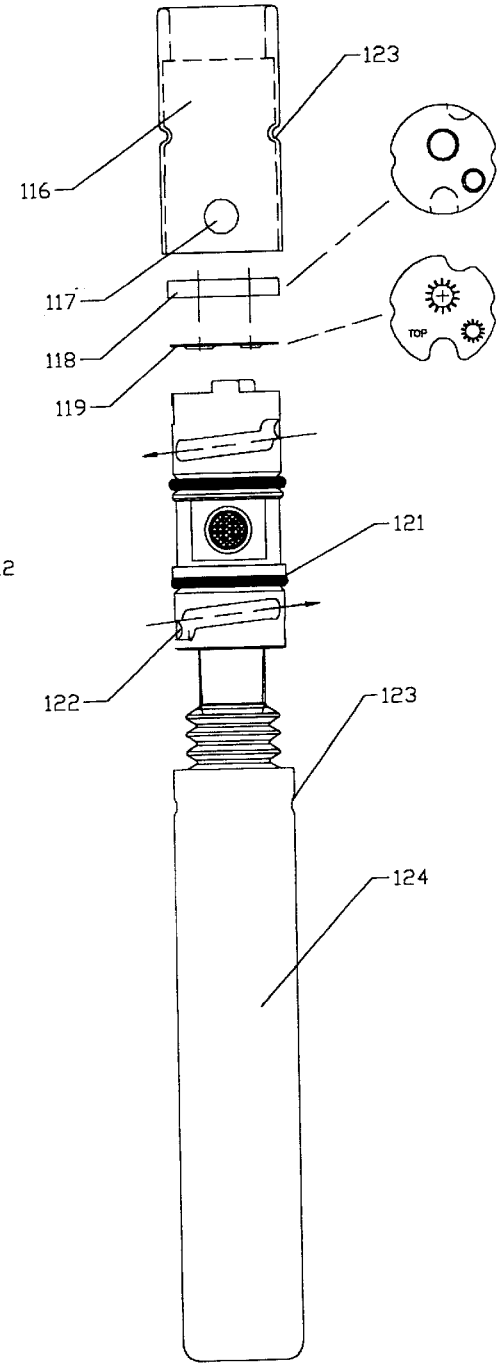
FIG. 2B is a different view of the pump of FIG. 2A showing the outer cover pieces.

FIG. 2A shows a bellows pump according to the invention in a disassembled state. FIG. 2B shows a different view of the pump of FIG. 2A, including the outer cover pieces. The pump head is shown generally at 108, and includes a top bayonet mount groove 109 and bottom bayonet mount groove 122. Note that, in the preferred embodiment, both grooves includes a stair step-type discontinuity, such that two intentional turns are required for assembly and disassembly. This two-step process provides a safety factor in the event that the covers 116 or 124 are under pressure when disassembling. O-rings 110 and 121 provide respective sealing for the cover 116 and body 124. The O-ring 110 helps to seal out grit, while applying a bayonet friction force, whereas ring 121 provides a compressed gas seal and bayonet friction force for the body 124.

Figure 4:
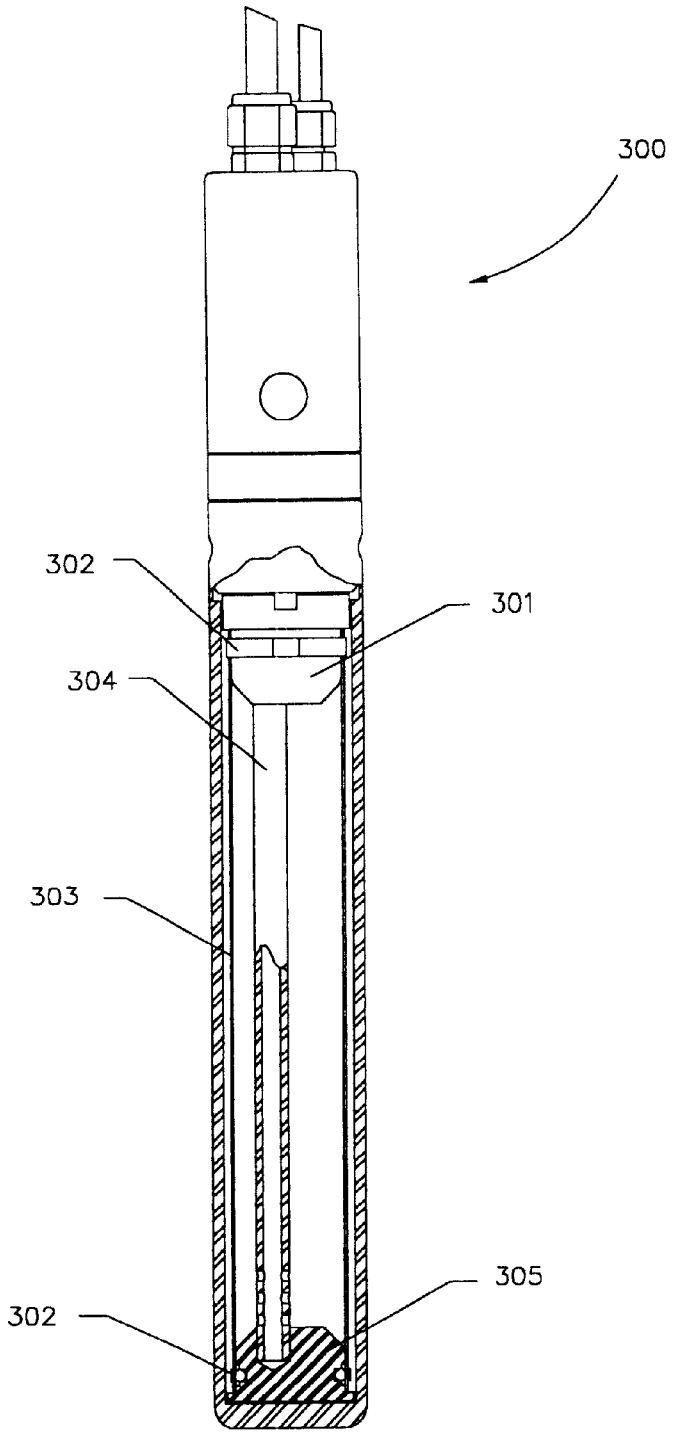
FIG. 4 is a drawing which shows an alternative embodiment according to the invention including a non-bellows bladder preferably composed of Teflon.

An inlet opening 117 is provided on both sides of the cover to eliminate the possibility of improper assembly. The inlet seat 111 having an O-ring 111' and an optional screen 112. Reference 113 is a grit groove in the form of an open space to contain any grit that might enter between the cover and the head. At the lower end of the manifold assembly, a barbed tube 114 is provided for bellows attachment. Although the barb is not necessary, this does aid in attachment, while ensuring that the bellows cannot be reused after removal to reduce chances of cross-contamination. The bellows shown is shown at 115. Although a corrugated bellows is shown, a Teflon bladder or sock may alternatively be used, as depicted in FIG. 4. In any case, it is assumed that the bellows itself is disposable following a sampling operation.

According to the invention, alternative apparatus and methods are provided for tubing attachment, enabling rapid assembly while minimizing complex, costly components. In FIG. 2A, for example, a top plate 101 is provided, preferably having anti-rotation pins to ensure precise positioning. A liquid discharge port is shown at 102, with the air inlet port being shown at 103. The discharge check ball 107 is retained by a discharge ball stop 105, which is inserted into the assembly with the use of an O-ring 106 providing a seal. An O-ring for the discharge tubing (not shown) is depicted at 104.

According to the one embodiment of the invention, a grab plate 119 is fitted over the top of the pump head 108, which is turn is covered by top plate 118, which functions to support the grab plate 119. The grab plate 119 includes a first opening with serrated fins in alignment with the liquid discharge port, and a second opening with serrated fins in alignment with the air inlet port 103. With the covers 116 and 124 placed onto the pump head 108 with the dimples 123 engaging with the respect grooves 109 and 122, the opening in the grab plate 119 are exposed at the top to receive respective tubes for fluid discharge and air inlet. In particular, with the tubings being sized in accordance with the finned serrated openings, both may simply be pushed into the respective openings, and locked into place due to the action of the serrated fins. The O-ring 104 automatically seals the discharge tube, with O-ring 120 performing the same function with respect to the air inlet. With appropriate sizing of the tubing and openings, the tubes may not be pulled out unless the entire unit is disassembled.

Figures 3A, 3B:
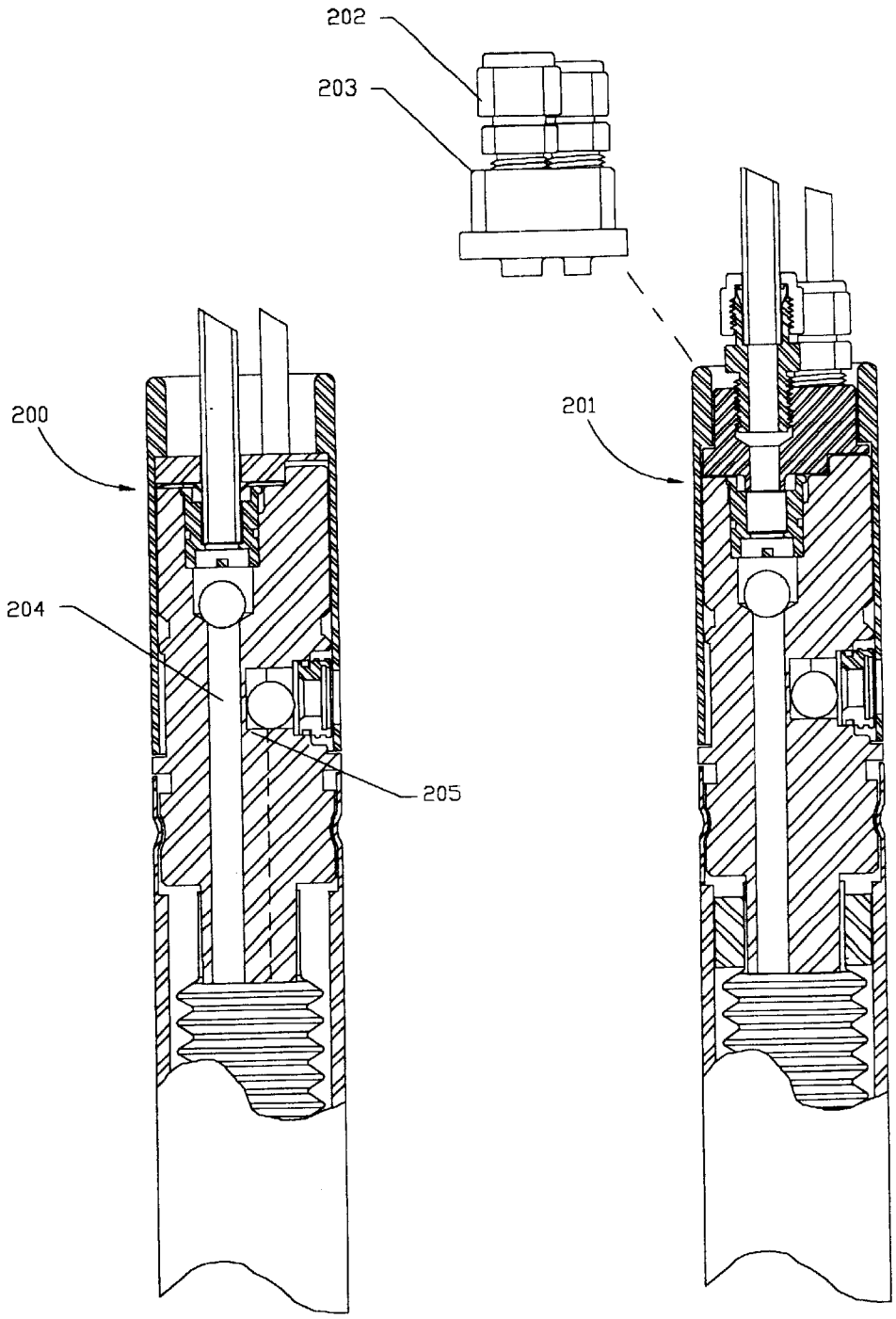
FIG. 3A is a drawing which shows an assembled bellows pump according to the invention including a disposable quick connection tubing grab plate.
FIG. 3B is a drawing which shows an assembled bellows pump according to the invention including a compression fitting adapter.

FIG. 3A is a drawing which shows an assembled bellows pump having a disposable quick connection tubing grab plate installed, in partial cross-section. The liquid discharge path is shown at 204, and the liquid inlet path shown at 205 through the side of the assembly. FIG. 3B illustrates the alternative use of a compression fitting adapter, installed in place of the tubing grab plate. The fitting adapter 203 includes compression fittings 202 into which the respective tubes are inserted and held into place by tightening on the nuts which, in turn, urges an O-ring or other type of elastomeric seal around the fluid discharge and air inlet ports.

FIG. 4 is a drawings which shows generally at 300 a bellows pump according to the invention including an alternative Teflon bladder 303. Apart from this modification, the upper portion of the pump may be similar, if not identical, to that depicted in previous figures, in that the grab plate and/or compression fitting adapters may be used in conjunction with the above-ground connections. The Teflon bladder alternative, preferably includes a top spool 301, clamp and O-ring 302 and discharge rod 304. The discharge rod 304 fits into a bottom spool 305, also including a clamp and O-ring assembly 302.

Figure 5A:
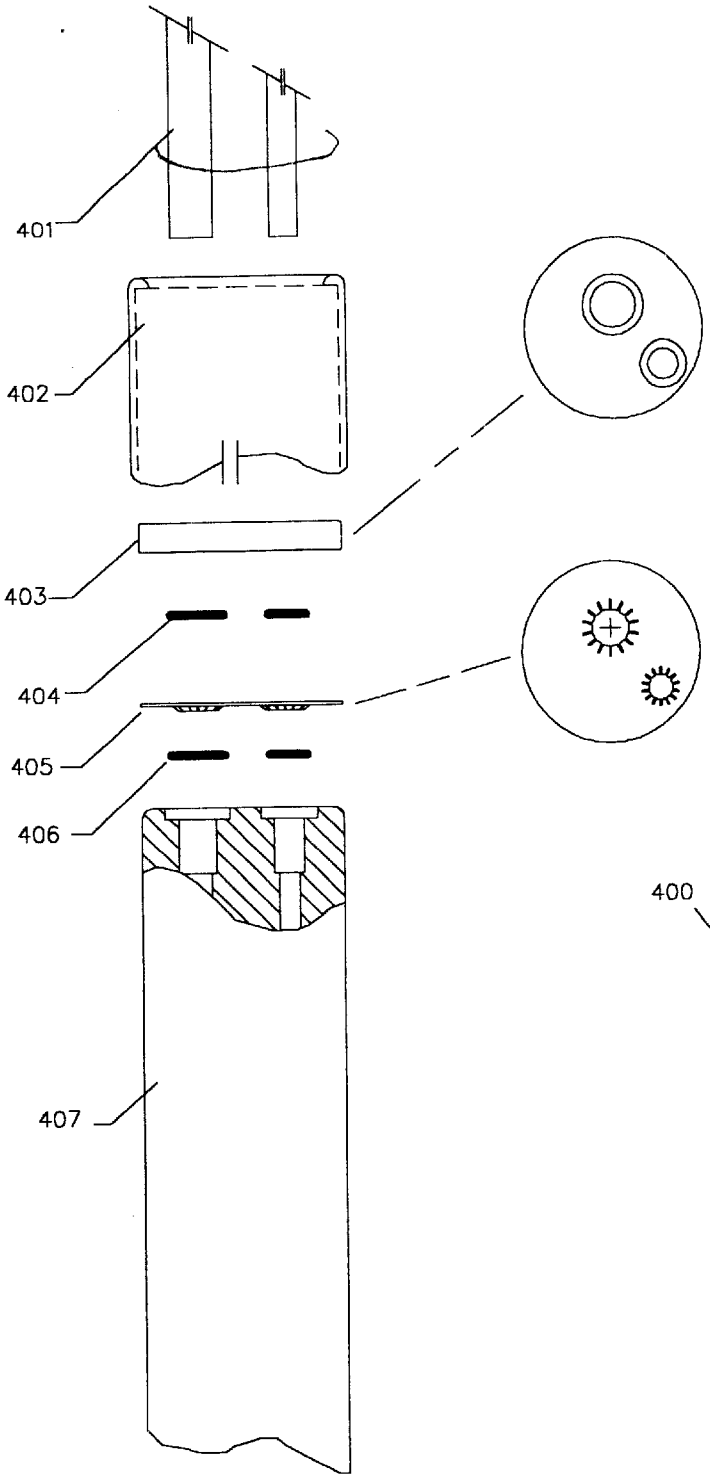
FIG. 5A is a drawing which shows an embodiment of the invention including a grab plate prior to tubing installation.
Figure 5B:
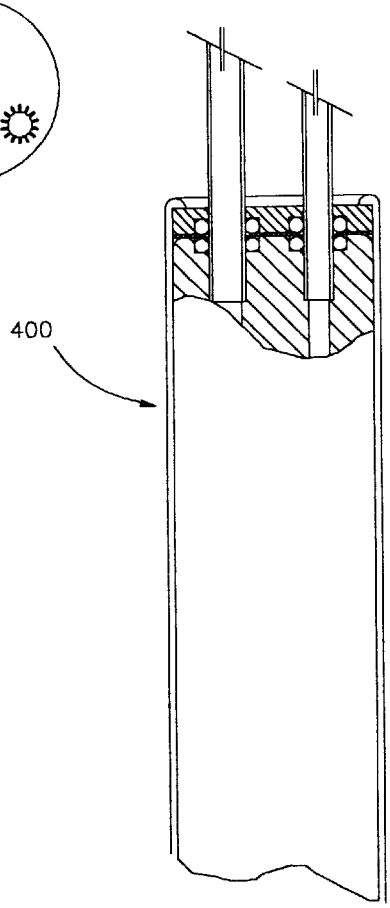
FIG. 5B is a drawing which shows the embodiment of FIG. 5A with the tubing permanently installed.

FIG. 5A is a drawing which shows an embodiment of the invention including a grab plate prior to installation of the tubes to the above-ground location. FIG. 5B is a drawing which shows the embodiment of FIG. 5A with the tube permanently installed. In this particular configuration, a set of lower O-rings 406 are provided for sealing against compressed gases, with the grab plate 405 being positioned above the O-rings 406. A second set of O-rings 404, primarily for sealing out liquid and for protection of the grab plate teeth, are placed in alignment with the openings, and the top plate is fitted over these components. With the upper body portion 402 installed thereover, and the tubes inserted, the configuration depicted generally at 400 is achieved as shown in FIG. 5B.

Figure 6A:
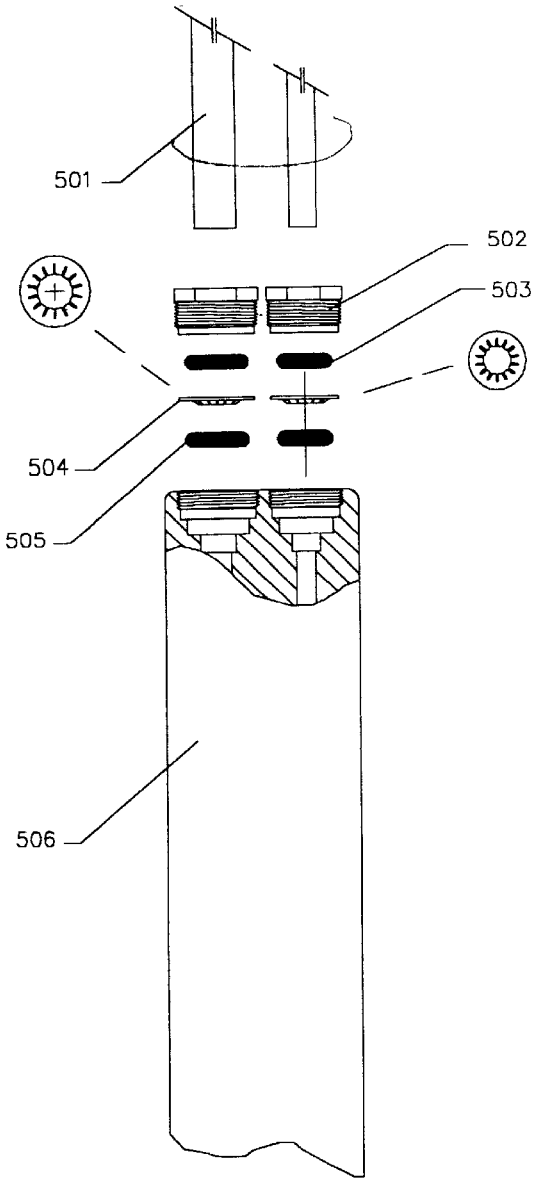
FIG. 6A is a drawing which shows an embodiment of the invention including grab rings and removable threaded bushings or fasteners prior to tubing installation.
Figure 6B:
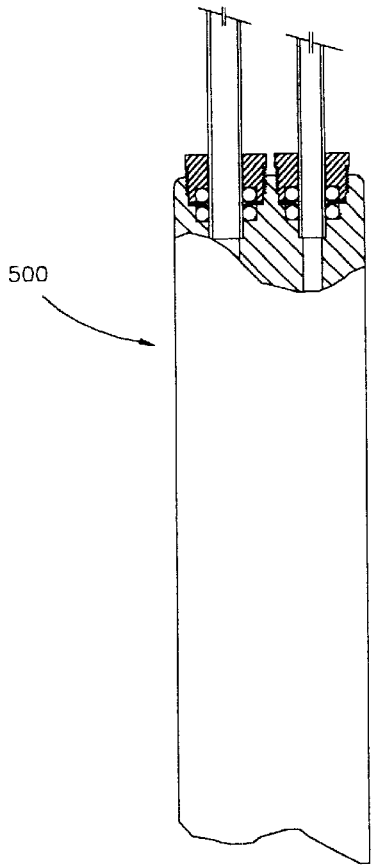
FIG. 6B is a drawing which shows the embodiment of FIG. 6A with the grab rings and removable threaded bushings or fasteners in an installed condition.

As an alternative to a grab plate having finned, serrated openings for both the fluid and gas lines, separate grab plates may be used, as shown in FIGS. 6A and 6B. FIG. 6A is an exploded view of this embodiment, including grab rings and removable threaded bushings or other fasteners prior to the tubing installation, and FIG. 6B is a drawing which shows the embodiment of FIG. 6A with the grab rings and removable threaded bushings or fasteners in an installed condition, including the fluid-discharge and air-inlet tubes 501. As in FIGS. 5A and 5B, a first set of O-rings 505 is preferably provided for sealing compressed gases, with a second set of O-rings 503 for sealing out liquid and protection of the teeth of grab rings 504. Threaded bushings 502 are then screws into the appropriate threaded mounts, enabling tubes 501 to be inserted, resulting the configuration shown generally at 500 in FIG. 6B. Note that although threaded bushings 502 are shown, these may be replaced with retaining rings or other means of fastening, including the cover assembly of the type shown in FIGS. 5A and 5B, with the separate grab rings 504 being used in lieu of the single grab ring 405.

I claim:

1. An air-operated pump configured to receive air-inlet and fluid-discharge tubes from an above-ground location for groundwater sampling and other applications, comprising:

a submersible pump body having a fluid inlet port, an air-supply port and a fluid-discharge port;

a removable cartridge disposed within the pump body, the cartridge being operable between a refill state, wherein fluid is drawn into the pump body through the fluid inlet port, and a discharge state wherein fluid is forced out of the pump body through the fluid-discharge port; and fittings enabling the air-inlet and fluid-discharge tubes to be respectively inserted and sealed into the air-inlet and fluid-discharge ports.

2. The air-operated pump of claim 1, wherein the fittings are such that the associated tubes cannot be removed without modification.

3. The air-operated pump of claim 1, wherein the fittings include a grab plate associated with one or both of the air-inlet and fluid-discharge ports.

4. The air-operated pump of claim 1, wherein the fittings include a compression adapter associated with one or both of the air-inlet and fluid-discharge ports.

5. The air-operated pump of claim 1, wherein the removable cartridge is a bellows.

6. The air-operated pump of claim 1, wherein the removable cartridge is a bladder.

7. The air-operated pump of claim 1, wherein the cartridge is removably attachable through a press fitting.

* * * * *